US005239705A

United States Patent [19]

Leopold

[11] Patent Number: 5,239,705

[45] Date of Patent: Aug. 31, 1993

[54] CAP WITH DECORATIVE HAIR ATTACHMENT

[76] Inventor: Lynnabeth Leopold, 23 Blvd. Des Philosophes, 1205 Geneva, Switzerland

[21] Appl. No.: 974,917

[22] Filed: Nov. 12, 1992

Related U.S. Application Data

[63] Continuation-in-part of Ser. No. 817,344, Jan. 6, 1992, Pat. No. 5,170,509.

[51] Int. Cl.[5] ..... A42B 1/00

[52] U.S. Cl. ..... 2/209.13; 2/918; 132/273

[58] Field of Search ..... 2/171, 195, 196, 198, 2/199, 209.1, 209.3, DIG. 6; 132/212, 273

[56] References Cited

U.S. PATENT DOCUMENTS

| | | | |
|---|---|---|---|
| 4,998,544 | 3/1991 | Obergfell | 2/209.3 |
| 5,003,640 | 4/1991 | Pizzacar | 2/DIG. 6 |
| 5,044,385 | 9/1991 | Rhodes | 132/273 |
| 5,170,509 | 12/1992 | Leopold | 2/199 |
| 5,174,312 | 12/1992 | Adams | 2/171 |

FOREIGN PATENT DOCUMENTS

| | | | |
|---|---|---|---|
| 785551 | 8/1935 | France | 132/273 |
| 2585543 | 2/1987 | France | 2/209.1 |

*Primary Examiner*—Clifford D. Crowder
*Assistant Examiner*—Diana L. Biefeld
*Attorney, Agent, or Firm*—Gregory J. Nelson

[57] ABSTRACT

An accessory item including a cap having a cut-out through which the wearer's hair may rearwardly extend. A decorative hair band is attached to the rear of the cap. In an alternate embodiment, a hair piece is attached to the hair band to simulate a natural braid or ponytail.

10 Claims, 6 Drawing Sheets

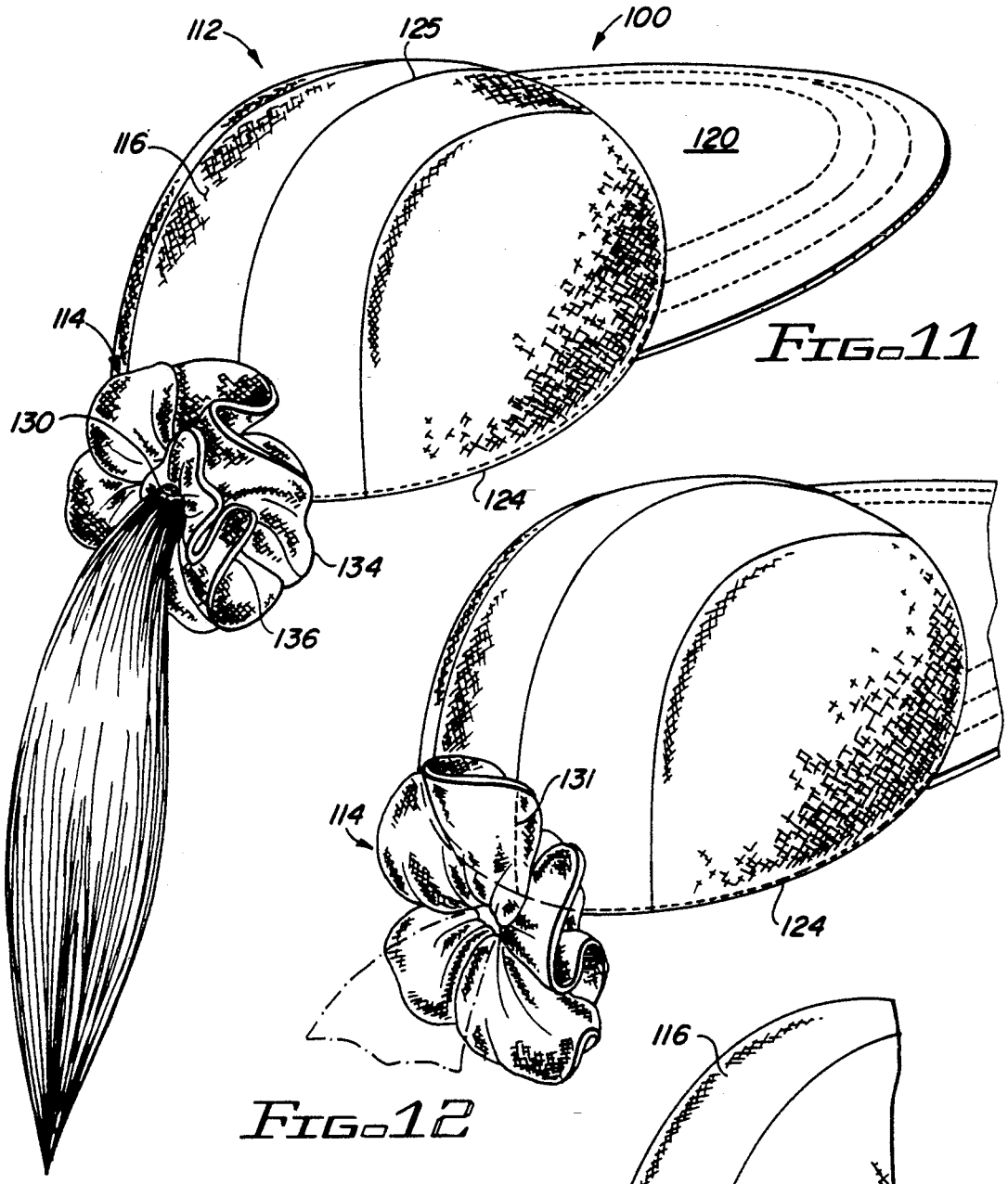
FIG. 11
FIG. 12
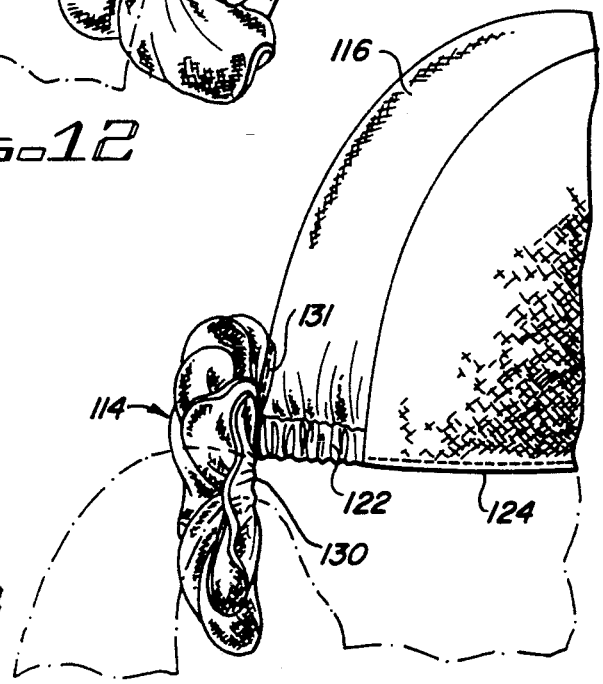
FIG. 13

CAP WITH DECORATIVE HAIR ATTACHMENT

This is a continuation-in-part application of application Ser. No. 07/817,344, filed Jan. 6, 1992, now U.S. Pat. No. 5,170,509 entitled "Cap With Decorative Hair Attachment".

The present invention relates to an item of apparel and more particularly relates to a cap or protective head covering which has a decorative hair band attachment which may be secured to the wearer's hair.

Caps of various styles and shapes have for some time been worn for protection and as a fashion accessory. Caps are often part of a coordinated outfit worn for some particular athletic activity such as baseball, roller skating, jogging or the like. One problem is that when a wearer actively engages in physical or athletic activities of this type, the cap may become askew or may be entirely dislodged from the user's head.

It may also be desirable for women with shortt or unkept hair or to utilize such fashionable caps incorporating a hair piece affixed to the decorative attachment which would give the appearance of a lengthy ponytail or braid.

Accordingly, it is a principle object of the present invention to provide a fashionable sports cap with a decorative hair band accessory which is attachable about the user's hair.

It is another object of the present invention to provide a cap and an integrally attached decorative, elasticized item which is securable to the user's hair.

It is another object of the present invention to provide a cap and an integrally attached decorative, elasticized accessory which incorporates a hair piece simulating a ponytail or braid.

It is a primary object of the present invention to provide a fashionable apparel item to be worn on the user's head with an attached decorative elastic hair band securable about the user's hair.

Briefly, the present invention includes a cap or head covering of the type having a crown portion which fits about the user's head and which cap may include a forwardly extending visor or bill. The rear of the crown has a cut-out portion and at least a portion of the periphery of the crown at the cut-out includes a band which adjusts the cap to fit various head sizes. A decorative hair band is attached to the rear of the cap which band is an annular fabric member which is elasticized having an aperture through which the wearer's hair may rearwardly extend. The hair band accessory serves to secure the cap in place, adds a fashionable appearance to the cap and also serves to at least partially cover the opening or cut-out at the rear of the cap. In an alternate embodiment, a hair piece is attached to the hair band to simulate a natural braid or ponytail. In an alternate embodiment, the hair band is positioned with its aperture below or partly below the lower edge of the cap.

The above and other objects and advantages of the present invention will be more fully understood from the following specification, claims and drawings in which:

FIGS. 11 to 14 illustrate an alternate embodiment of the cap and hair band of the present invention.

Figure 1:
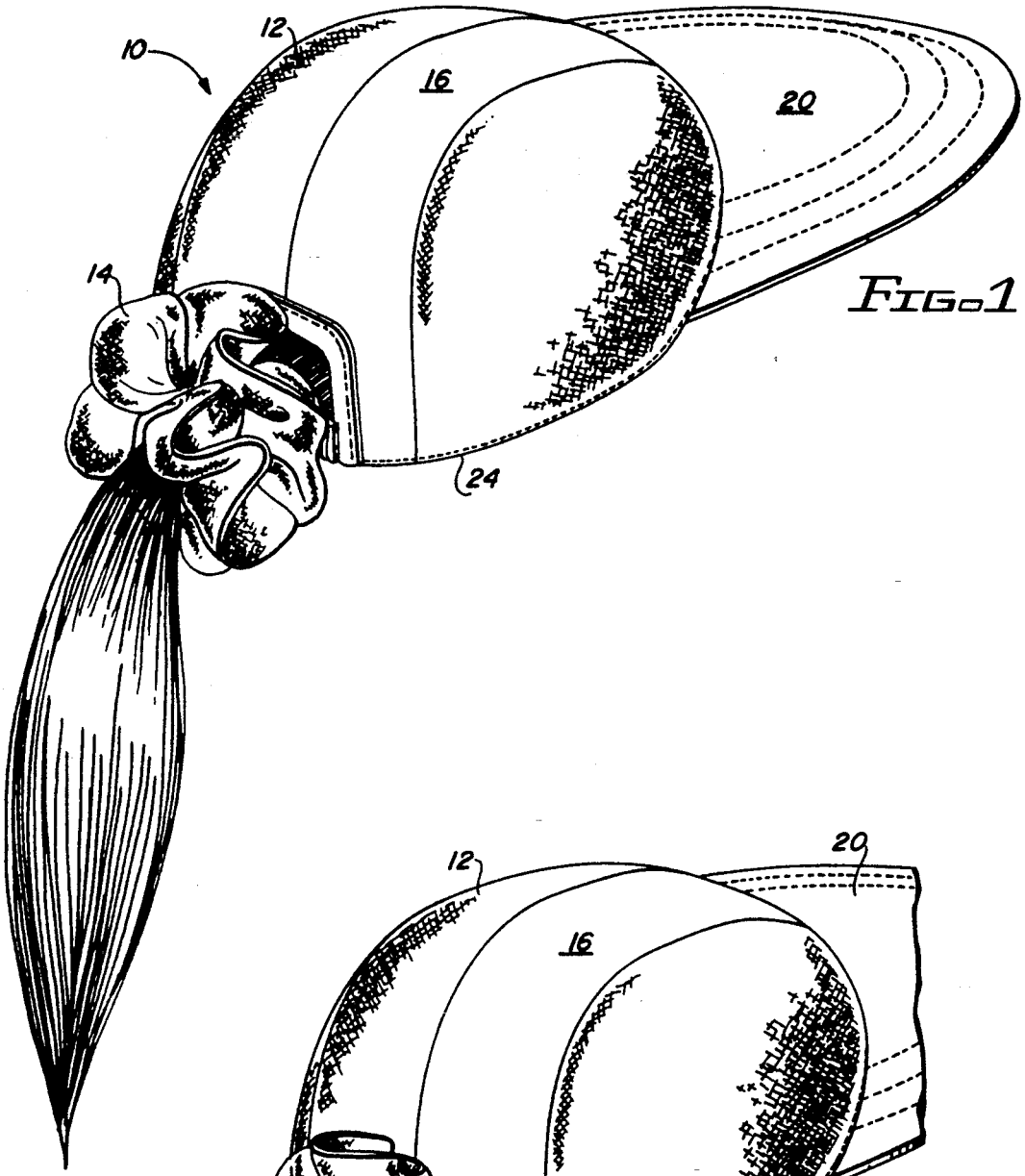
FIG. 1 is a rear perspective view of the cap and hair band showing the hair band doubled around the ponytail of a wearer.

Turning now to the drawings, the cap and hair band apparel item is generally designated by the numeral 10 an includes cap portion 12 and hair band 14. The cap 12 can be of any conventional design and is shown having a crown 16 of fabric which rests on the upper part of the head of the user. The cap may be constructed of any suitable material such as cloth, fabric, plastic, leather or a combination of these materials. A bill or visor 20 extends forwardly from the front of the cap and is relatively rigid and when worn generally occupies the position above the eyes of the wearer. The visor is optional.

The rear of the cap is provided with a cut-out 22 which extends upwardly from the lower peripheral edge 24 of the cap. The cut-out 22 may be defined by a seam or edge 26. A strap 28 extends across the opening or cut-out generally aligned with the lower peripheral edge 24 of the cap. The strap provides for adjustment so the cap may be worn by individuals having different head sizes. Generally the strap will be elasticized or may be adjustable in length at a buckle or a plurality of apertures in one strap which selectively register with posts in an overlapping strap as is well known. The particular construction to achieve adjustability may vary and for purposes of illustration, an elasticized strap is shown which strap may expand and contract with the particular head size characteristics of the user.

Figure 2:
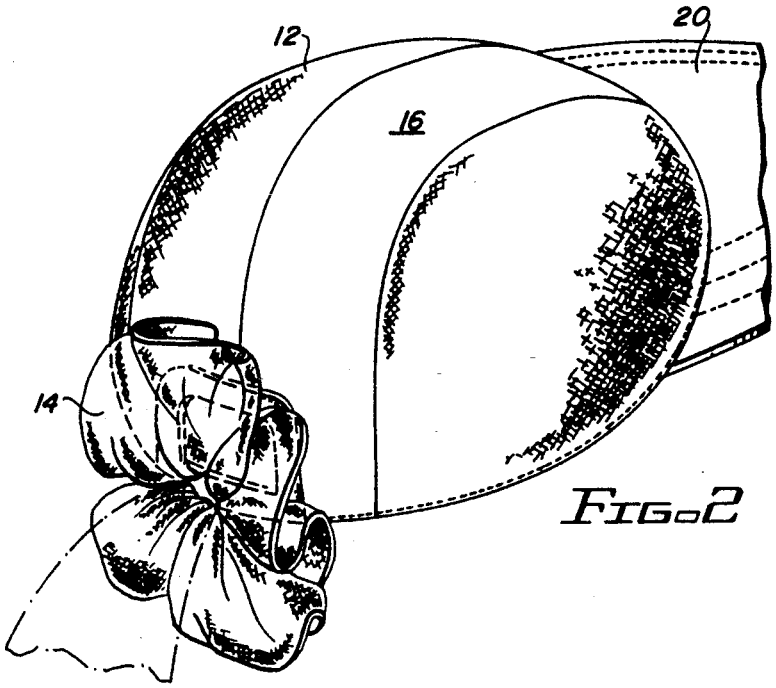
FIG. 2 is a view similar to FIG. 1 with the user's hair shown extending through the hair band and the hair band broken away to illustrate the cut-out in the rear of the cap.
Figure 3:
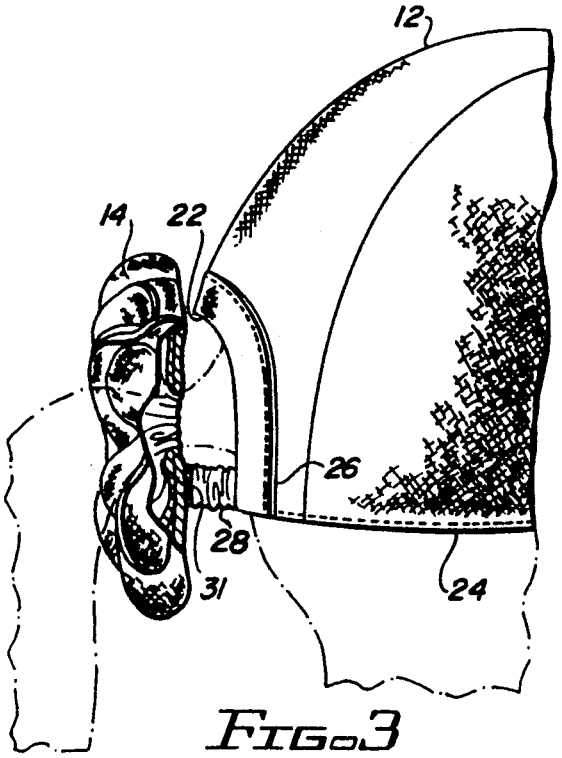
FIG. 3 is a side view showing the rear of the cap, hair band and ponytail.
Figure 4:
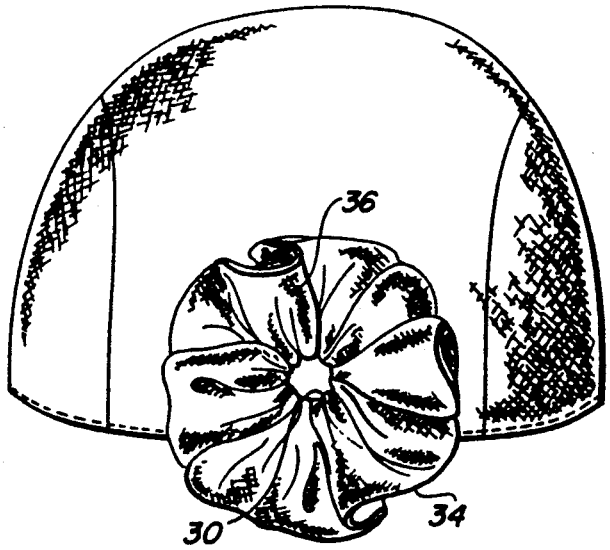
FIG. 4 is a rear view of the cap and hair band.

Hair band 14 is shown attached to the exterior of the rear of the cap in a position generally aligned with the recess 22. The hair band 14 is both a decorative item and a functional fashion accessory. The hair band is preferably fabricated from a suitable fabric material and is annular in configuration having a central aperture 30 about which an elasticized member extends as will be more fully explained hereafter. The hair band has an outer peripheral edge 34 and in its normal position as best shown in FIGS. 2 and 4, is gathered so as to form a plurality of ruffles or pleats 36. The aperture 30 generally aligns with the cut-out 22 at the rear of the cap and the hair band is secured to the cap at a suitable location. Preferably, as shown, the hair band is secured to the cap at a location below aperture 30 by a suitable tack stitch 31. Alternatively, the hair band can be detachably secured to the cap at matting loop and hook members or by suitable snap fastener.

Figure 5:
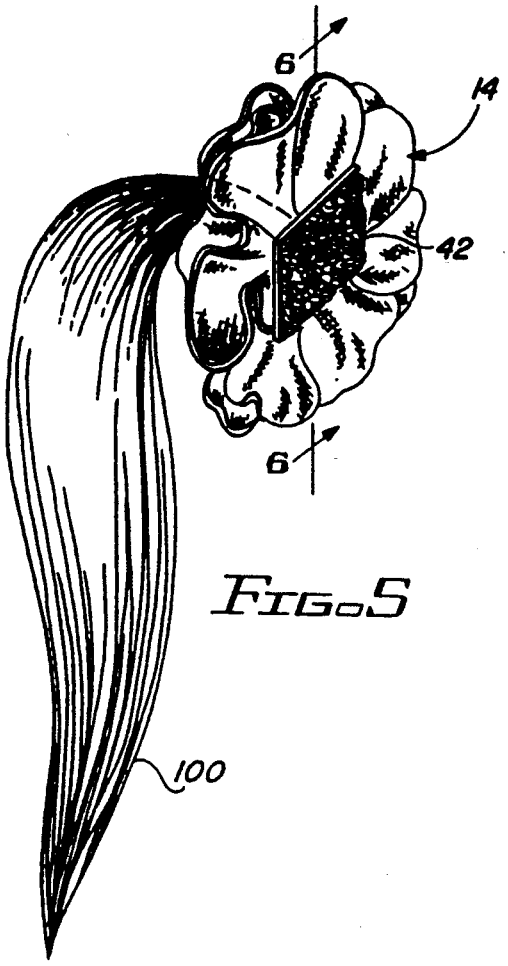
FIGS. 5 and 6 illustrate an alternate construction in which the hair band is detachably secured to the cap.
Figure 6:
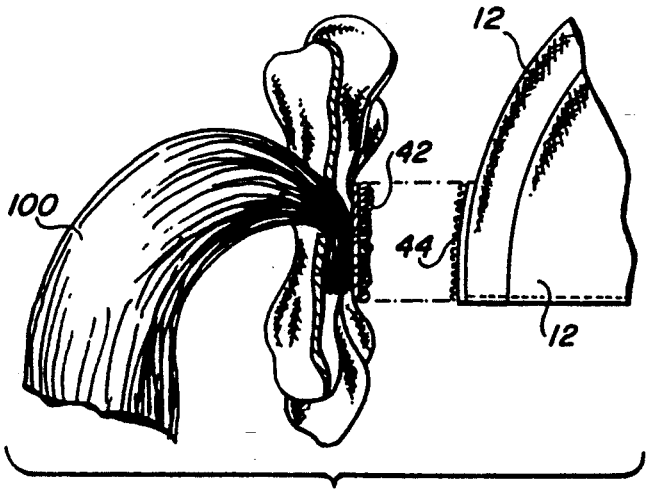

FIGS. 5 and 6 illustrate the detachable securement of the hair band 14 to the rear of the hat 12 by detachable loop and hook fastener members 42 and 44, such as the type sold under the trademark Velcro.

Figure 10:
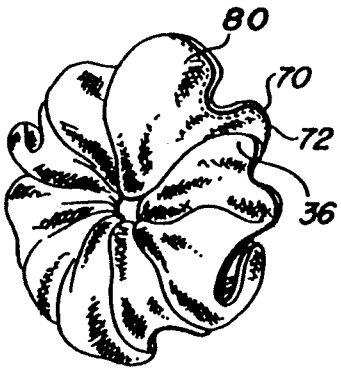
Figure 7:
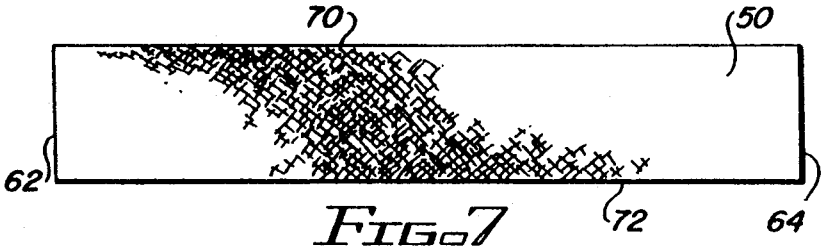
Figure 9:
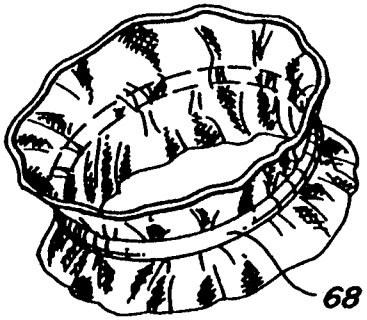

The construction of the hair band is shown in FIGS. 7 and 10. As indicated above, the band may be made from any suitable material such as a fabric of the desired color or pattern. A cotton fabric will work well for this purpose.

Figure 8:
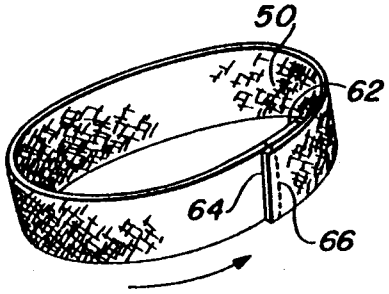
FIGS. 7 to 10 illustrate the steps in the construction of the hair band.

The strip of fabric is selected and cut into a generally elongate, rectangular piece 50 as shown in FIG. 6. The piece 50 is formed into a generally circular construction and ends joined as seen in FIG. 8. The opposite ends 62, 64 of the assembly are then sewn together at 66 so that a continuous circular band is formed. An elastic member 68 is placed about the exterior of the fabric band. The elastic member 68 has a diameter less than the diameter of the fabric band.

The elasticized band 68 is small enough so that it will tend to pull or gather the assembly together forming the pleats or ruffles 36 as has been described. The outer edges 70 and 72 of the band are then joined by a finishing stitch at 80 resulting in the construction shown.

In use, the wearer will place the cap on the wearer's head and a section of the wearer's hair extended through the cut-out 22 and through the aperture 30 in the hair band. The wearer's hair may be in the form of a ponytail, as shown, or a braid or any similar gathered hair style. The hair is extended through the aperture at the rear of the cap and then through the elasticized opening at the center of the hair band. The combination provides the practical advantage of the cap protecting the wearer's head and also shading the wearer's eyes.

The addition of the hair band provides the desirable appearance of a fashion accessory and provides substantial practical advantages. The hair band assists in securing the cap on the head of the user so that it will not shift or fall off. The hair band being decorative and ruffled and of a size larger than the cut-out 22 will also serve to at least partially cover or obscure the opening in the rear of the cap. The band also serves the purpose of securing the user's hair so that a separate band or other hair appliance will not necessarily have to be secured to the user's hair.

In FIG. 1, the cap and hair band are shown and in FIG. 1, the hair band has been twisted in figure-8 fashion and doubled over itself and the user's hair extended through the band. The doubled effect gives a fuller more ruffled appearance and may be preferred by some wearer's.

In FIG. 5, the hair band is shown with an artificial ponytail 100 which is secured to the hair band. Thus, if the wearer does not have long hair, the wearer can achieve the appearance of having longer hair.

Referring to FIGS. 11 to 14, another embodiment of the present invention is generally designated by the numeral 100 and includes a cap 112 and attached hair band 114. The cap again may be of any conventional design and is shown having a crown 116 which is placed on the head of the user. The cap may be constructed of suitable material such as cloth, fabric, plastic, leather or a combination of these materials. A bill or visor 120 extends forwardly to shade the eyes of the wearer although the bill or visor is an optional component of the cap.

In the embodiment 100, the crown of the cap 112 does not require an opening or cut-out at the rear as shown in previous embodiments. The lower edge of the cap is defined by a peripherally extending edge 124 and may have an elasticized portion 122 to provide size adjustability.

Hair band 114 is shown attached to the exterior of the rear of the cap in a central position generally aligned with the centerline of the cap. A seam 125 is shown extending along the centerline although the seam is shown primarily for purposes of reference and may or may not be a portion of the cap.

The hair band 114 is again a decorative item and a functional fashion accessory and may be fabricated from any suitable fabric material and again is annular in configuration having a central aperture or opening 130 and a peripheral edge 134. In the embodiment shown in FIGS. 11 to 14, the opening 130 is elasticized and as has been explained above with reference to FIGS. 7 to 10, an elastic band may be incorporated in the device forming a plurality of pleats or ruffles 136.

Figure 14:
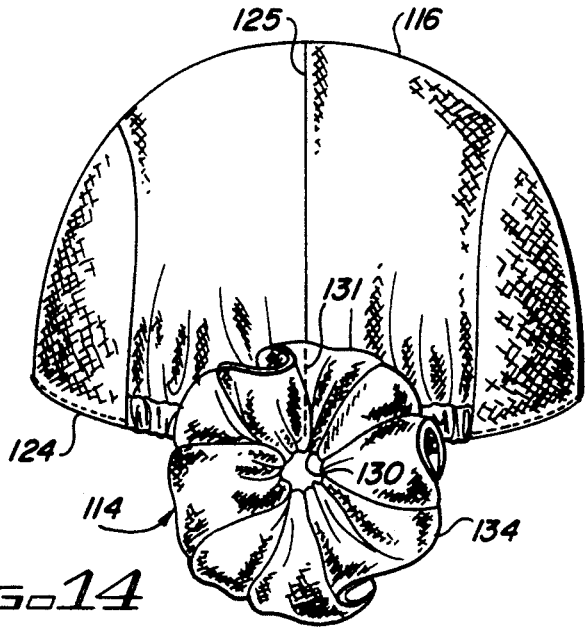

Preferably the hair band is secured to the cap in a position with the aperture 130 positioned at or slightly below the peripheral edge 124 of the cap, as best seen in FIGS. 13 and 14. The hair band may be secured by a suitable means and is preferably tack-stitched at 131 as shown. In use, the wearer may extend the wearer's hair either through the opening 131 as shown in FIG. 12 or may extend the wearer's hair in a ponytail or braid downwardly beneath the hair band as shown in FIG. 11.

Figure 15:
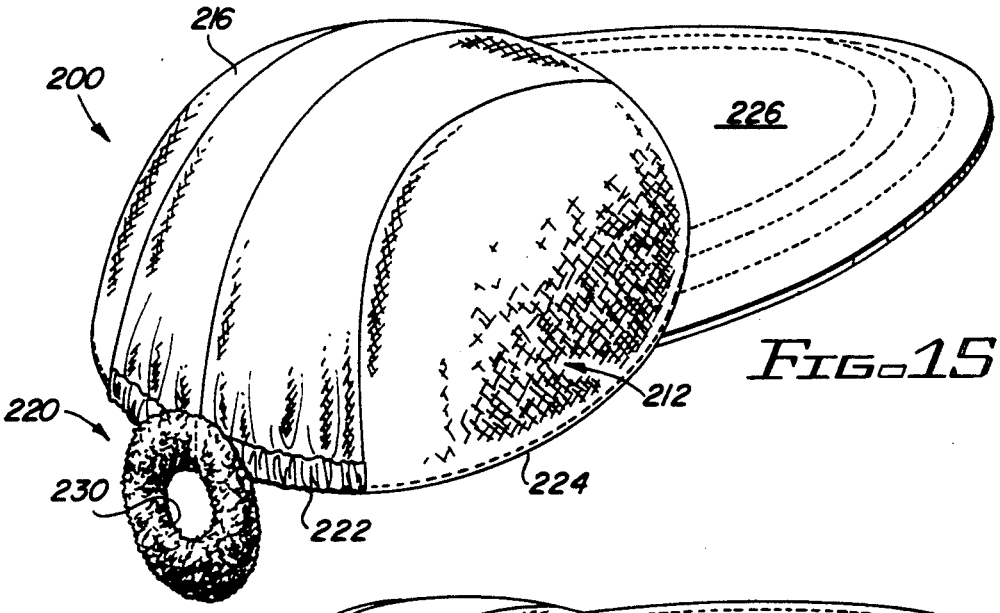
FIGS. 15 and 16 illustrate yet another embodiment of the present invention.
Figure 16:
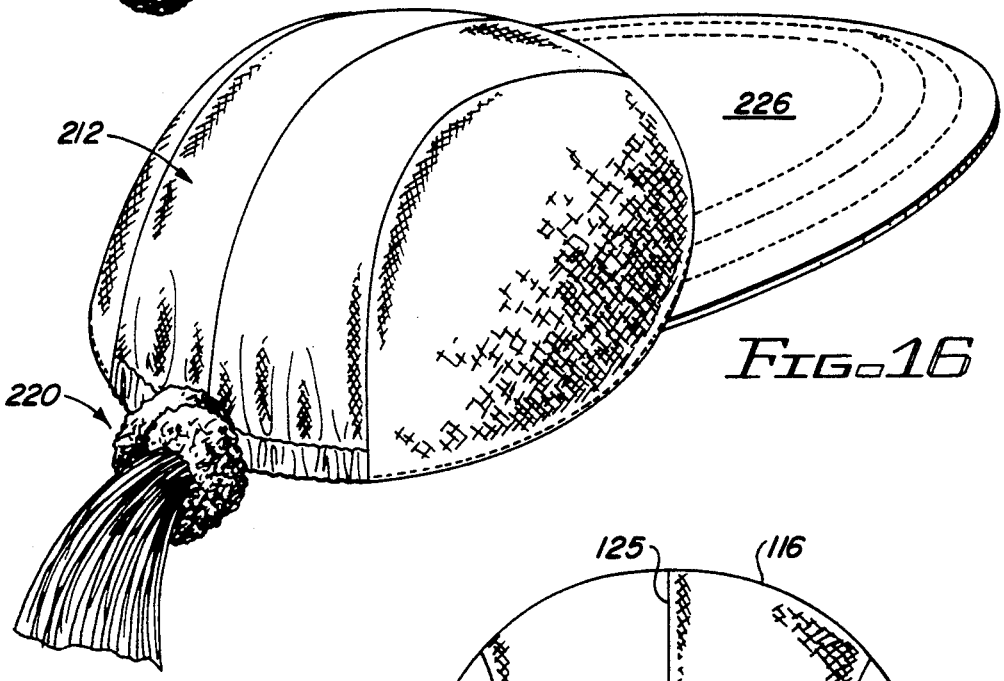

FIGS. 15 and 16 show still another embodiment of the present invention which is generally designated by the numeral 200. Embodiment 200 again includes a cap portion 212 having a bill or visor 226 extending forwardly. The cap includes a crown 216 which is worn on the head of the user, the crown being defined by a lower peripheral edge 224. Cap 200 is shown as being devoid of any opening at the rear of the cap but is provided with an elasticized band 222 so the cap may fit snugly on various head sizes.

The hair band 220 is shown as being annular in configuration and made from any suitable material such as an elasticized terry cloth or any other commonly used woven, elasticized material which is suitable for the purpose of securing hair in a ponytail or similar fashion. Use of an elasticized fabric material may make it unnecessary to incorporate an elastic band in the hair band. The band 220 may also be fabricated generally as shown in FIGS. 7 to 10. The material of the band may be decorated with any design or applied itmes such as rhinestones, studs or the like.

The annular hair band 220 in cross section has a generally tubular configuration and in contrast to the hair band shown, as for example, in FIGS. 11 to 14, is devoid of ruffles or pleats. A central aperture 230 is elasticized either by virtue of the entire device being made from elasticized material or by the inclusion of an elasticized member extending around the periphery of the opening 230. The purpose of the elasticized opening is so that the wearer's hair may be extended through the hair band as shown in FIG. 14. The hair band 220 is again positioned at a central location at the rear of the cap with the aperture 230 positioned at or slightly below the lower peripheral edge 224 of the cap. The cap may also be worn as shown in FIG. 13.

It will be obvious to those skilled in the art to make various changes, alterations and modifications to the invention described herein. To the extent that these changes, alterations and modifications do not depart from the spirit and scope of the appended claims, they are intended to be encompassed therein.

I claim:

1. An apparel item comprising:

(a) a cap having a crown which is to be worn on the wearer's head, said cap having a front and rear and being defined by a lower edge; and (b) a hair band having an aperture therein, said hair band being attached to the rear of the cap with the aperture positioned at least partially below the lower edge of the cap, said hair band including elasticized means for engaging at least a portion of the hair of the user whereby the user may extend a portion of the user's hair through said aperture in said band to secure said cap and hair in place.

2. The apparel item of claim 1 wherein said cap has a forwardly extending visor disposed at the front of the cap.

3. The apparel item of claim 1 wherein said cap includes means for adjusting the size of said cap to various head sizes.

4. The apparel item of claim 1 wherein said hair band is generally annular having peripherally extending ruffles.

5. The apparel item of claim 1 wherein said hair band is generally annular in configuration.

6. The apparel item of claim 1 wherein said hair band is fabricated from fabric and includes an elastic band peripherally extending about said aperture.

7. The apparel item of claim 5 wherein said hair band is fabricated from an elasticized fabric material.

8. The apparel item of claim 1 wherein said hair band is detachably secured to said cap.

9. The apparel item of claim 8 wherein said hair band and said cap are detachably secured by cooperating mating loop and hook fabric fastener members.

10. The apparel item of claim 1 including an attachable hair piece which simulates a ponytail or braid.

* * * * *